US012297604B2

(12) United States Patent
Dodd

(10) Patent No.: US 12,297,604 B2
(45) Date of Patent: May 13, 2025

(54) E-CLIP INSTALLATION MACHINE

(71) Applicant: Hoyt E. Dodd, Lula, GA (US)

(72) Inventor: Hoyt E. Dodd, Lula, GA (US)

( * ) Notice: Subject to any disclaimer, the term of this patent is extended or adjusted under 35 U.S.C. 154(b) by 0 days.

(21) Appl. No.: 18/117,021

(22) Filed: Mar. 3, 2023

(65) Prior Publication Data

US 2023/0279617 A1 Sep. 7, 2023

Related U.S. Application Data

(60) Provisional application No. 63/315,999, filed on Mar. 3, 2022.

(51) Int. Cl.
*E01B 29/24* (2006.01)
*E01B 3/16* (2006.01)
*E01B 9/60* (2006.01)

(52) U.S. Cl.
CPC ..... *E01B 29/24* (2013.01); *E01B 3/16* (2013.01); *E01B 9/60* (2013.01); *E01B 2201/00* (2013.01); *E01B 2203/015* (2013.01)

(58) Field of Classification Search
CPC . E01B 29/24; E01B 29/29; E01B 3/16; E01B 9/60; E01B 2201/00; E01B 2201/08
See application file for complete search history.

(56) References Cited

U.S. PATENT DOCUMENTS 1,814,901 A * 7/1931 Dickson ..... E01B 29/24 254/121
2,696,971 A * 12/1954 Philbrick ..... E01B 29/13 104/2
3,430,578 A * 3/1969 Stewart ..... E01B 29/14 104/7.1
4,068,593 A * 1/1978 Leeves ..... E01B 29/24 104/17.2
4,479,440 A * 10/1984 Burr ..... E01B 29/24 227/107
5,584,247 A * 12/1996 Almaraz ..... E01B 29/24 104/2

FOREIGN PATENT DOCUMENTS

WO WO-9744530 A1 * 11/1997 ..... E01B 29/13

* cited by examiner

*Primary Examiner* — Zachary L Kuhfuss
*Assistant Examiner* — Cheng Lin
(74) *Attorney, Agent, or Firm* — Jones IP Law, LLC; Dennis W. Jones

(57) ABSTRACT

An e-clip installation machine for securing rails to steel ties via automating and reducing the time required for installing e-clips that attach rails to steel ties is provided. The e-clip installation machine automates the process of securing rails to steel ties via inserting e-clips into a respective shoulder clip on either side of the two rails. A pair of hydraulic jaws clamp the steel tie and bring it up against the underside of the rails. Two e-clips for each rail are placed in position at the respective shoulder clips. Two pairs of hydraulic clamp mechanisms, corresponding to each rail, press the respective e-clips through openings within the respective shoulder clips. The e-clip installation assembly includes a jaw assembly and two clamp assemblies. Each clamp assembly includes a pair of clamp mechanisms, positionable on either side of a rail in proximity to a shoulder clip affixed to a steel tie. A clamp mechanism is utilized to compress an e-clip within an opening of the shoulder clip.

8 Claims, 19 Drawing Sheets

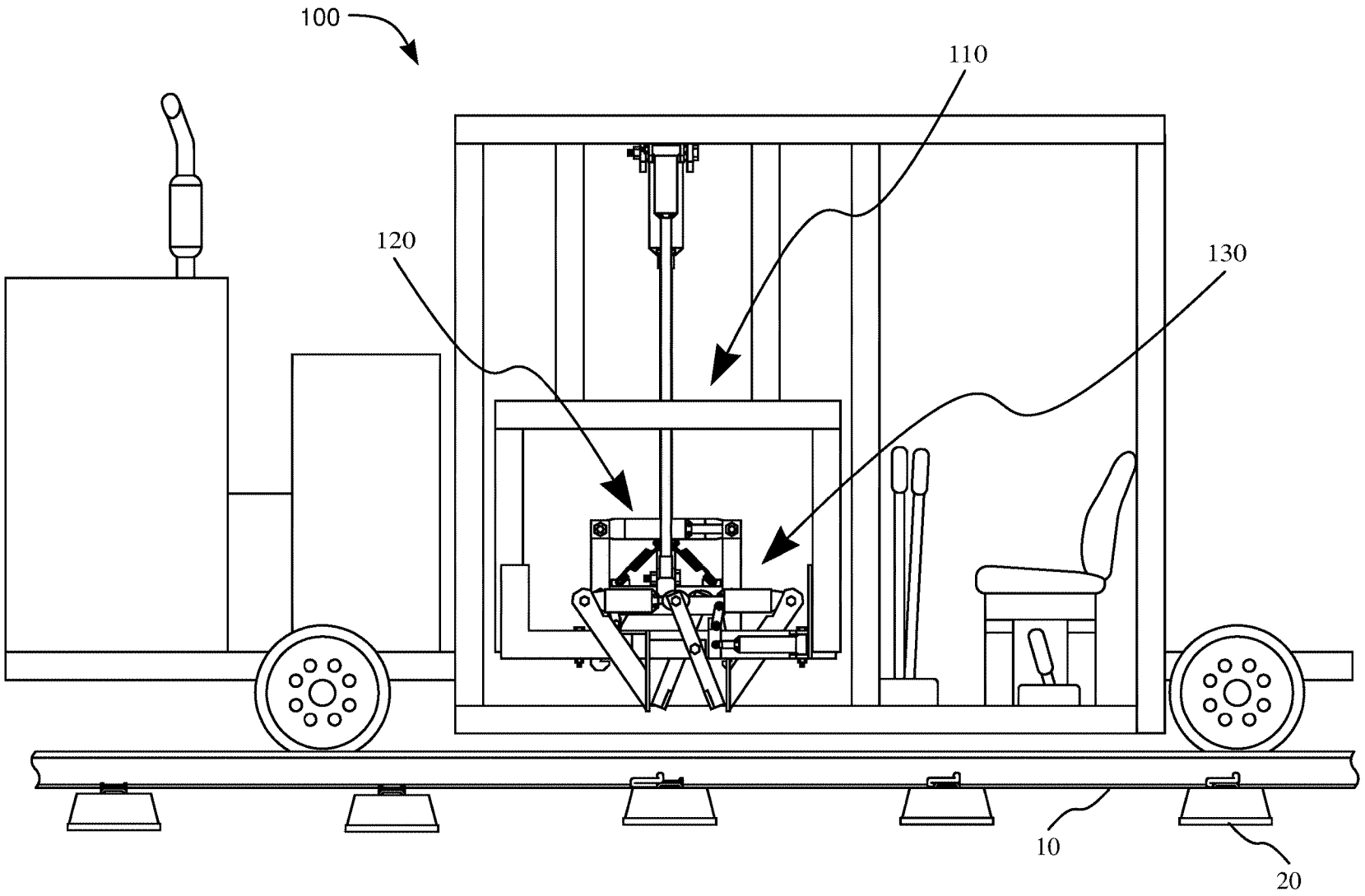
Fig. 1-A

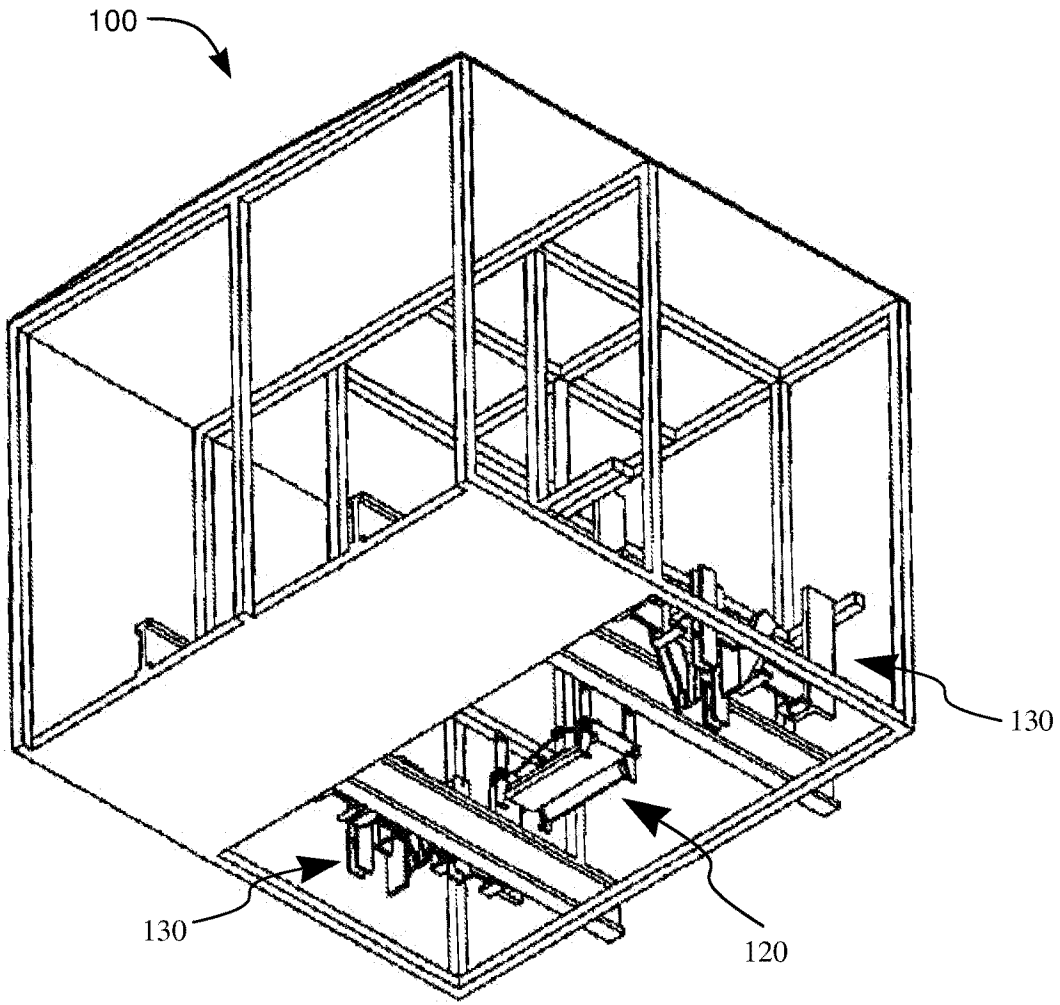
Fig. 1-B

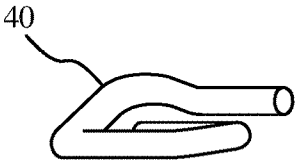
Fig. 5-A (Prior Art)
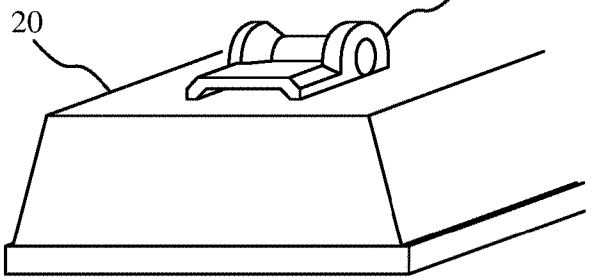
Fig. 5-B (Prior Art)
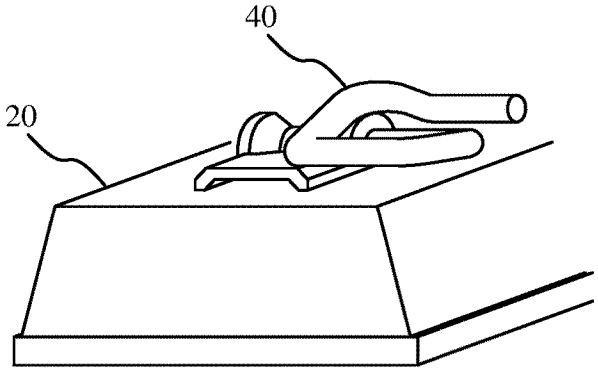
Fig. 5-C (Prior Art)
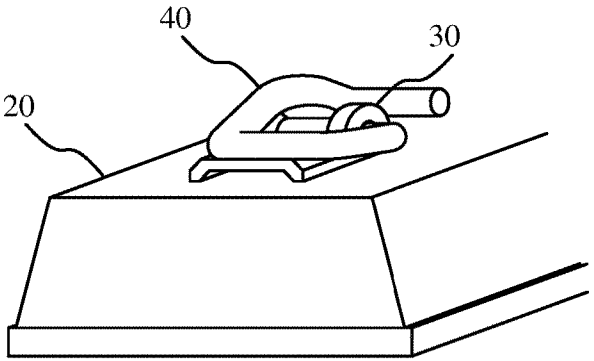
Fig. 5-D (Prior Art)

E-CLIP INSTALLATION MACHINE

BACKGROUND

This invention pertains to replacing railroad cross ties. More particularly, this invention pertains to a machine for securing rails to steel ties via automating and reducing the time required for installing the e-clips that attach the rails to the steel ties.

The life expectancy of wooden cross ties can sometimes be as short as ten years, depending on environmental conditions and other factors. Steel ties may function adequately for up to 50 years before requiring maintenance or repairs. Additionally, after being replaced steel ties can be recycled as scrap or even repaired and then returned to service. Therefore, steel ties are more cost-effective and sustainable than many other options. With such increased life expectancy and then the possibility of re-use, it becomes readily apparent why modern railway construction and maintenance involves replacing wooden cross ties with more durable steel ties. Securing the rails to the steel ties has until now been an arduous manual process where each of four e-clips are attached to respective shoulder clips affixed to the steel tie on either side of the two rails. Each e-clip has heretofore been attached individually at its specific location via arduous manual labor.

The disclosed e-clip installation machine is rail mounted to move along the railroad track. The e-clip installation machine improves the process of securing the rails to the steel ties via increasing the efficiency of inserting the e-clips into a respective shoulder clip attached to the steel tie and located on either side of the two rails. A hydraulic jaw assembly is utilized to clamp the steel tie and lift it against the underside of the rails. The respective pairs of e-clips, two (2) clips for each rail, are then placed in position at the respective shoulder clips. Clamping mechanisms are utilized at each rail to simultaneously press the respective e-clips through the opening within the respective shoulder clips.

After completing the installation of the e-clips at both ends of the steel tie, the e-clip installation machine is moved along the track so that the jaw assembly is situated over the next steel tie to repeat the process.

BRIEF SUMMARY

An e-clip installation machine improves the process of securing rails to steel ties via increasing the efficiency of inserting e-clips into a respective shoulder clip on either side of the two rails. A pair of hydraulic jaws are utilized to clamp the steel tie and lift it against the underside of the rails. The respective pairs of e-clips, two clips for each rail, are then placed in position at the respective shoulder clips. Two pairs of hydraulic clamp mechanisms, one pair corresponding to each rail, are then utilized to press the respective e-clips through openings within the respective shoulder clips.

The e-clip installation assembly includes a jaw assembly and two clamp assemblies. Each clamp assembly includes a pair of clamp mechanisms, wherein each clamp mechanism is positionable on either side of a rail in proximity to a shoulder clip affixed to a steel tie. A clamp mechanism is utilized to compress an e-clip within an opening of the shoulder clip.

The jaw assembly is substantially midway between the two clamp mechanisms and provides for lowering the jaws into the rail bed with two pair of jaws straddling the steel tie along its length. The jaw grips are then closed to grip the steel tie and lift it against the lower portion of the rails for installation of the e-clips.

Specifically, the e-clip installation machine includes two clamp assemblies, each including a pair of clamp mechanisms for positioning on either side of a rail and in proximity to a shoulder clip affixed to a rail tie, so that each clamp mechanism is operable to compress an e-clip within an opening of the shoulder clip. Each clamp assembly includes two clamp mechanisms having a support frame, two clamp portions at the support frame and positionable on either side of the respective rail, and a clamp hydraulic cylinder for closing and opening the respective clamp portions to secure the respective e-clips to the corresponding shoulder portion. The e-clip installation machine also includes a jaw assembly situated substantially midway between the two clamp assemblies, and having two pairs of jaws positionable to straddle a rail tie along its length, wherein the jaws close on and lift the rail tie upwards against the respective rails. The jaw assembly also includes a mounting attachment for lowering into position at the rail tie, an attached jaw guide including a flat plate type material angled for alignment with the rail tie. Two pairs of jaw grips are attached to each of the jaws, and are positionable for gripping and lifting the rail tie against the respective rails. A corresponding jaw grip hydraulic cylinder operates to open and close each pair of jaw grips.

The jaw assembly and the pair of clamp assemblies of the e-clip installation machine are utilized to install respective e-clips to respective shoulder clips on either side of each rail near each end of the rail tie.

Other systems, methods, features and advantages of the present invention will be or become apparent to one with skill in the art upon examination of the following drawings and detailed description. It is intended that all such additional systems, methods, features and advantages be included within this description and be within the scope of the present disclosure.

BRIEF DESCRIPTION OF THE DRAWINGS

The above-mentioned features will become more clearly understood from the following detailed description read together with the drawings in which:

FIG. 1-A is a side view of an e-clip installation machine on a railroad track;

FIG. 1-B is a perspective view from the underside of an e-clip installation machine;

FIG. 5-A is an illustration of an exemplary e-clip (Prior Art);

FIG. 5-B is an illustration of an exemplary shoulder clip affixed to a steel tie (Prior Art);

FIG. 5-C is an illustration showing an e-clip in position for installation through the opening of a shoulder clip (Prior Art);

FIG. 5-D is an illustration showing an e-clip installed into a shoulder clip (Prior Art);

DETAILED DESCRIPTION

Figure 2:
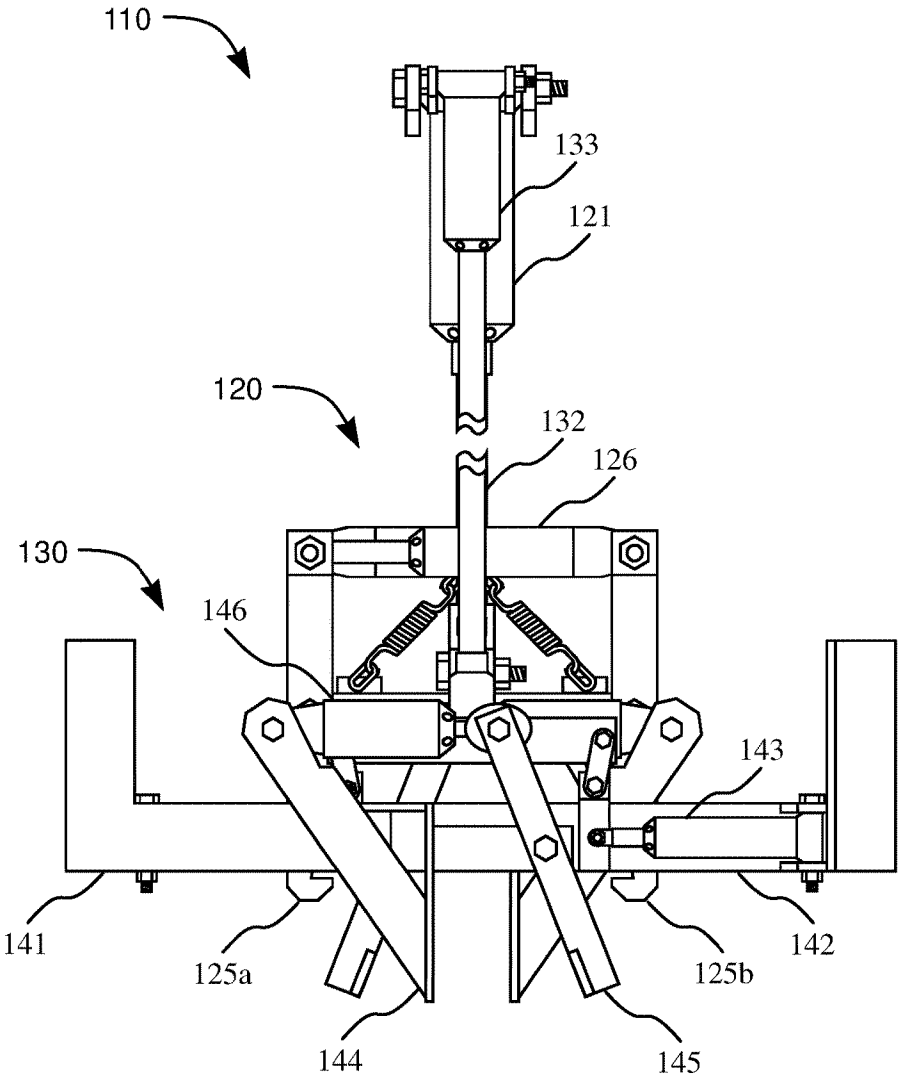
FIG. 2 is a side view of the e-clip installation assembly.

An e-clip installation machine for securing rails to steel ties via automating and reducing the time required for installing the e-clips that attach the rails to the steel ties is provided. The e-clip installation machine improves the process of securing rails to steel ties via increasing the efficiency of inserting e-clips into a respective shoulder clip on either side of the two rails. A pair of hydraulic jaws clamp the steel tie and bring it up against the underside of the rails. Two e-clips for each rail are placed in position at the respective shoulder clips. Two pairs of hydraulic clamp mechanisms, corresponding to each rail, are utilized to press the respective e-clips through openings within the respective shoulder clips.

The e-clip installation assembly includes a jaw assembly and two clamp assemblies. Each clamp assembly includes a pair of clamp mechanisms, wherein each clamp mechanism is positionable on either side of a rail in proximity to a shoulder clip affixed to a steel tie. A clamp mechanism is utilized to compress an e-clip within an opening of the shoulder clip.

The jaw assembly is substantially midway between the two clamp mechanisms and provides for lowering the jaws into the rail bed with two pair of jaws straddling the steel tie along its length. The jaw grips are then closed to grip the steel tie and lift it against the lower portion of the rails for installation of the e-clips.

The life expectancy of wooden cross ties can sometimes be as short as ten years, depending on environmental conditions and other factors. Steel ties may function adequately for up to 50 years before requiring maintenance or repairs. Additional, after being replaced steel ties can be recycled as scrap or even repaired and then returned to service. Therefore, steel ties are more cost-effective and sustainable than many other options. With such increased life expectancy and then the possibility of re-use, it becomes readily apparent why modern railway construction and maintenance involves replacing wooden cross ties with more durable steel ties. Securing the rails to the steel ties has until now been an arduous manual process where each of four e-clips are attached to respective shoulder clips affixed to the steel tie on either side of the two rails. Each e-clip has heretofore been attached individually at its specific location via arduous manual labor.

The disclosed e-clip installation machine is rail mounted to move along the railroad track. The e-clip installation machine improves the process of securing the rails to the steel ties via increasing the efficiency of inserting the e-clips into a respective shoulder clip attached to the steel tie and located on either side of the two rails. A hydraulic jaw assembly is utilized to clamp the steel tie and lift it against the underside of the rails. The respective pairs of e-clips, two (2) clips for each rail, are then placed in position at the respective shoulder clips. Clamping mechanisms are utilized at each rail to simultaneously press the respective e-clips through the opening within the respective shoulder clips.

After completing the installation of the e-clips at both ends of the steel tie, the e-clip installation machine is moved along the track so that the jaw assembly is situated over the next steel tie to repeat the process.

Specifically, the e-clip installation machine includes two clamp assemblies, each including a pair of clamp mechanisms for positioning on either side of a rail and in proximity to a shoulder clip affixed to a rail tie, so that each clamp mechanism is operable to compress an e-clip within an opening of the shoulder clip. Each clamp assembly includes two clamp mechanisms having a support frame, two clamp portions at the support frame and positionable on either side of the respective rail, and a clamp hydraulic cylinder for closing and opening the respective clamp portions to secure the respective e-clips to the corresponding shoulder portion. The e-clip installation machine also includes a jaw assembly situated substantially midway between the two clamp assemblies, and having two pairs of jaws positionable to straddle a rail tie along its length, wherein the jaws close on and lift the rail tie upwards against the respective rails. The jaw assembly also includes a mounting attachment for lowering into position at the rail tie, an attached jaw guide including a flat plate type material angled for alignment with the rail tie. Two pairs of jaw grips are attached to each of the jaws, and are positionable for gripping and lifting the rail tie against the respective rails. A corresponding jaw grip hydraulic cylinder operates to open and close each pair of jaw grips.

The jaw assembly and the pair of clamp assemblies of the e-clip installation machine are utilized to install respective e-clips to respective shoulder clips on either side of each rail near each end of the rail tie.

FIG. 1-A is a side view of the e-clip installation machine 100 situated on the rails 10 of a railroad track. FIG. 1-B is a perspective view from the underside of e-clip installation machine. The e-clip installation machine 100 includes an e-clip installation assembly 110 for installing the e-clips 40 and securing the rails 10 to the steel ties 20. The e-clip installation machine 100 is rail mounted to move along the rails 10 of a railroad track during the installation process. The e-clip installation machine 100 includes a driver section having a seat and controls for operation of the e-clip installation assembly 110. The driver section and the e-clip installation assembly 110 section are protected by a roof type covering. The e-clip installation machine 100 also includes a power section for operations power and movement, and also includes a flat bed portion behind the driver section for supplies, tools, and the like.

In the illustrated embodiment the e-clip installation machine 100 includes a jaw assembly and clamp assemblies that utilize a series of hydraulics and other systems for moving and operating the various portions of the machine to install the e-clips. While the various hydraulic cylinders within the relevant systems are shown in the drawings, the various tubes and controls necessary for operation of the included hydraulic cylinders are not shown. Those of skill in the art will understand and appreciate that such hydraulics tubes and controls are a necessary part of such systems, even though such are not always shown in the attached drawings.

In FIG. 1-B, the location of the clamp mechanisms 130 relative to the jaw assembly 120 is illustrated. The jaw assembly 120 is substantially midway between the two clamp mechanisms 130 and provides for lowering the jaws into the rail bed with two pair of jaws respectively straddling the steel tie 20 along its length. The jaw assembly 120 grips and lifts the steel tie 20 against the underside of the rails 10 for installation of the e-clips 40 via the two pair of clamp mechanisms 130.

Figure 3:
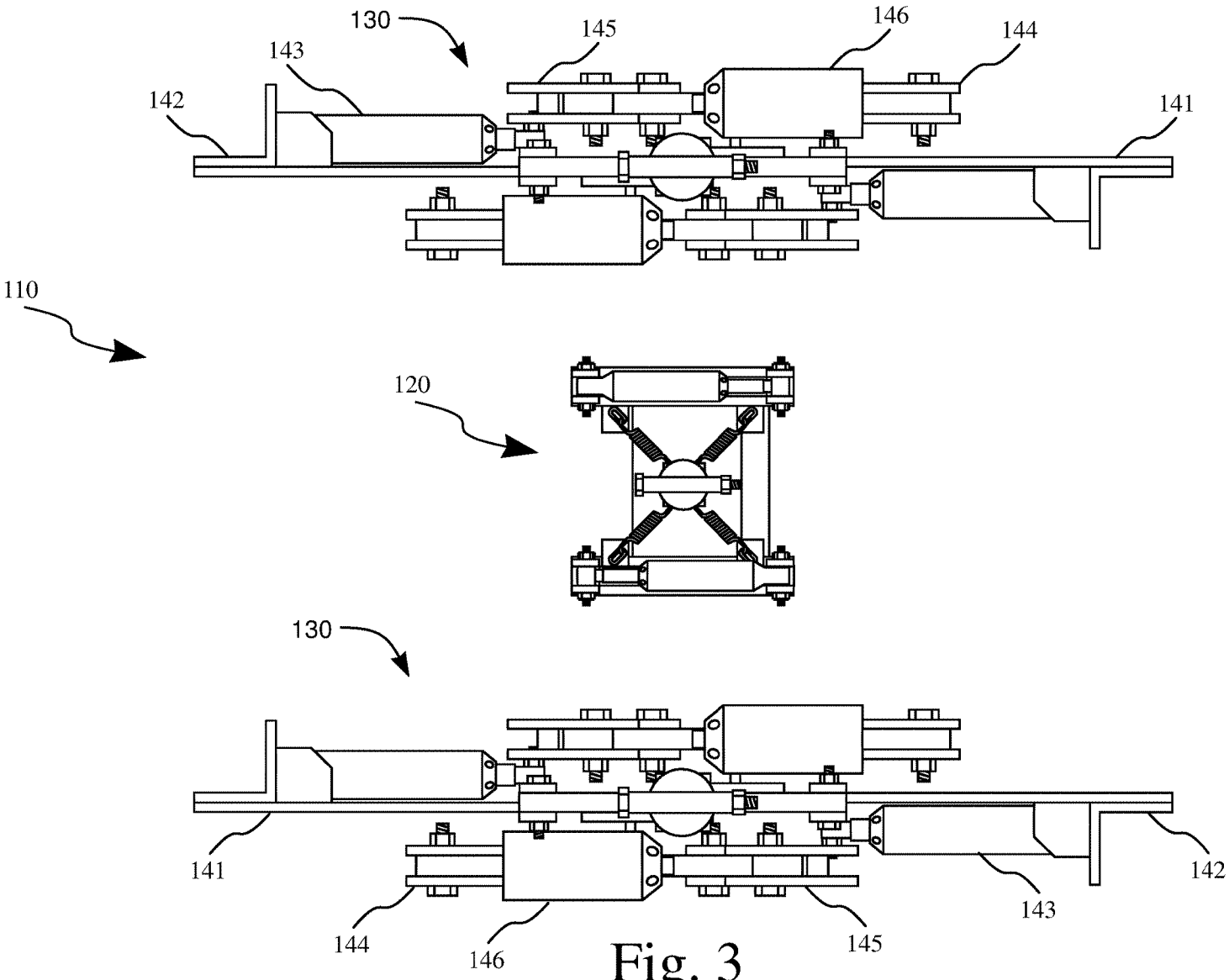
FIG. 3 is a top view of the e-clip installation assembly.
Figure 4:
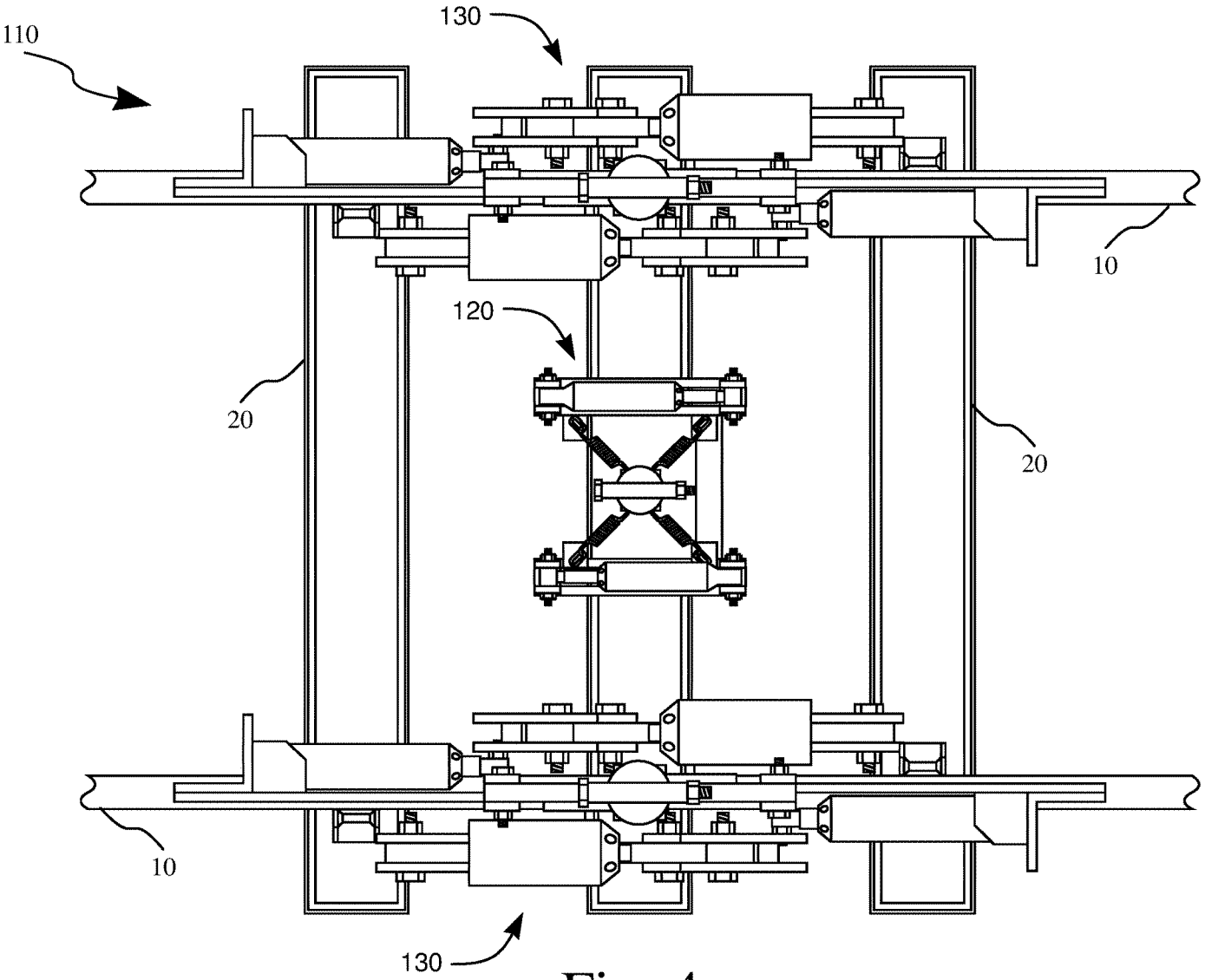
FIG. 4 is a top view of the e-clip installation assembly aligned with a railroad track.

FIG. 2 is a side view of the e-clip installation assembly 110, FIG. 3 is a top view of the e-clip installation assembly 110, and FIG. 4 is a top view of the e-clip installation assembly 110 aligned with a railroad track. The e-clip installation assembly 110 includes a jaw assembly 120 and two clamp assemblies. The various components of the jaw assembly 120 and the clamp assemblies are discussed in further detail below.

The e-clip installation machine 100 improves the process of securing the rails 10 to the steel ties 20 via increasing the efficiency of inserting the e-clips 40 into a respective shoulder clip 30 on either side of the two rails 10. A pair of hydraulic jaws are utilized to clamp the steel tie 20 and lift it against the underside of the rails 10. The respective pairs of e-clips 40, two clips for each rail 10, are then placed in position at the respective shoulder clips 30. Two pairs of hydraulic clamp mechanisms 130, one pair corresponding to each rail 10, are then utilized to press the respective e-clips 40 through openings within the respective shoulder clips 30.

The e-clip installation assembly 110 includes a jaw assembly 120 and two clamp assemblies. Each clamp assembly includes a pair of clamp mechanisms 130, wherein each clamp mechanism 130 is positionable on either side of a rail 10 in proximity to a shoulder clip 30 affixed to a steel tie 20. A clamp mechanism 130 is utilized to compress an e-clip 40 within an opening of the shoulder clip 30.

The jaw assembly 120 is substantially midway between the two clamp mechanisms 130. The jaw assembly 120 provides for lowering the jaws into the rail bed with two pair of jaws respectively straddling the steel tie 20 along its length. The jaw grips are then closed to grip the steel tie 20 and lift it against the lower portion of the rails 10 for installation of the e-clips 40.

FIG. 5-A is an illustration of an exemplary e-clip 40, FIG. 5-B is an illustration of an exemplary shoulder clip 30 affixed to a steel tie 20, FIG. 5-C is an illustration showing an e-clip 40 in position for installation through the opening of a shoulder clip 30, and FIG. 5-D is an illustration showing an e-clip 40 installed into a shoulder clip 30. FIG. 5-A through FIG. 5-D are all prior art examples as is known in the art and are so noted in the respective figures of the drawings.

An e-clip 40 is made so that one portion is insertable into the opening of the shoulder clip 30 on the steel tie 20 and a substantially parallel portion fits onto the flat portion of a rail 10. Illustrations that show an e-clip 40 installed within a shoulder clip 30 on a steel tie 20 and also in position on a rail 10 are shown in the drawings at FIG. 8, FIG. 9, FIG. 10, FIG. 13, FIG. 14, FIG. 15, FIG. 16, FIG. 17, and FIG. 18 that are discussed in detail below.

Figure 6:
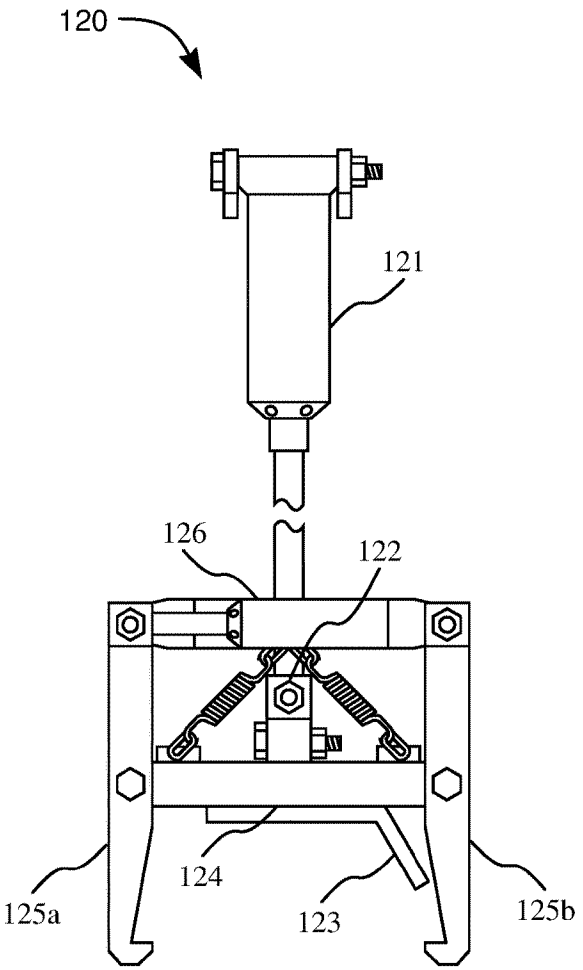
FIG. 6 is a side view of the jaw assembly.
Figure 7:
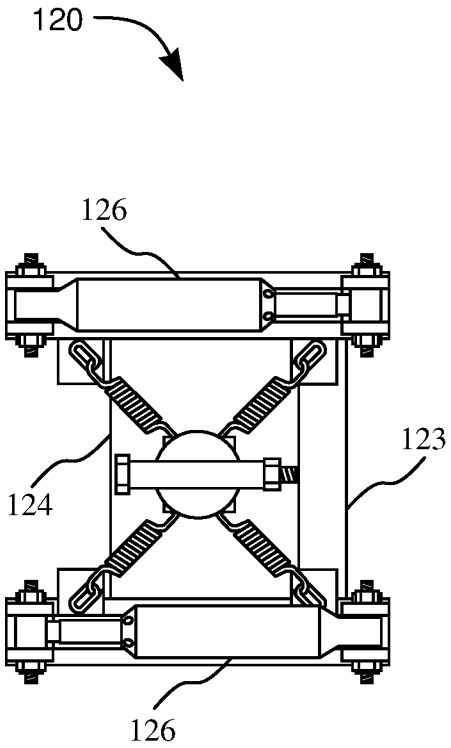
FIG. 7 is a top view of the jaw assembly.

FIG. 6 is a side view of the jaw assembly 120, and FIG. 7 is a top view of the jaw assembly 120. The jaw assembly 120 is situated substantially midway between the clamp mechanisms 130 at either end of the e-clip installation assembly 110. As the e-clip installation machine 100 is moved along the railroad track, the jaw assembly 120 is positioned over the next available steel tie 20 for initiating the process of installing e-clips 40 within the shoulder clips 30 to secure the rail 10 to the steel tie 20.

The jaw assembly 120 includes a jaw position hydraulic cylinder 121, a mounting attachment 122, a jaw guide 123, a jaw brace 124, two pairs of jaw grips 125*a*. 125*b*, and a pair of jaw grip hydraulic cylinders 126. One jaw grip hydraulic cylinder 126 is operable for each pair of jaw grips 125*a*. 125*b*. The jaw position hydraulic cylinder 121 extends downward from the upper portion of the e-clip installation assembly 110. The piston rod of the jaw position hydraulic cylinder 121 extends downward from the barrel to the mounting attachment 122. The mounting attachment 122 is attached to the jaw guide 123. The jaw guide 123 is a substantially flat plate type material having one edge portion angled downward for loose alignment with the steel ties 20. Operation of the jaw position hydraulic cylinder 121 forces the jaw guide 123 downward against the steel tie 20. The angle portion of the jaw guide 123 causes a proper alignment with the angled edge of the steel tie 20 so that the jaw assembly 120 is aligned in a manner to lift the steel tie 20 without tilting and to further ensure that the steel tie 20 is flat against the underside of the rails 10.

The jaw assembly 120 includes two pairs of jaw grips 125*a*, 125*b*. The first pair of jaw grips 125*a*, 125*b* are visible in the drawings of FIG. 6 while the second pair are situated opposite and aligned parallel with the first pair into the page of the drawing. The second pair of jaw grips 125*a*, 125*b* are clearly visible in FIG. 7 showing the top view of the jaw assembly 120.

A jaw brace 124 extends horizontally between each pair of jaw grips 125*a*, 125*b* and aligns with the jaw guide 123. The jaw brace 124 connects at each end near the midpoint of the respective jaw grips 125*a*, 125*b* to create a pivot point around which the jaw grips 125*a*, 125*b* open and close according to the action of the jaw grip hydraulic cylinder 126. The jaw grip hydraulic cylinder 126 operates to open the jaw grips 125*a*, 125*b* by contracting so that the upper portion of the jaw grips 125*a*, 125*b* become closer together thus opening the lower portion of the jaw grips 125*a*, 125*b*. Conversely, the jaw grip hydraulic cylinder 126 operates to close the jaw grips 125*a*, 125*b* toward the steel tie 20 by extending so that the upper portion of the jaw grips 125*a*, 125*b* are further apart.

The jaw assembly 120 is substantially midway between the two clamp assemblies 130. The jaw assembly 120 provides for lowering the jaw grips 125*a*, 125*b* into the rail bed with two pair of jaws respectively straddling the steel tie 20 along its length. The jaw grips 125*a*, 125*b* are then closed to grasp the steel tie 20 and lift it against the lower portion of the rails 10 for installation of the e-clips 40.

Figure 8:
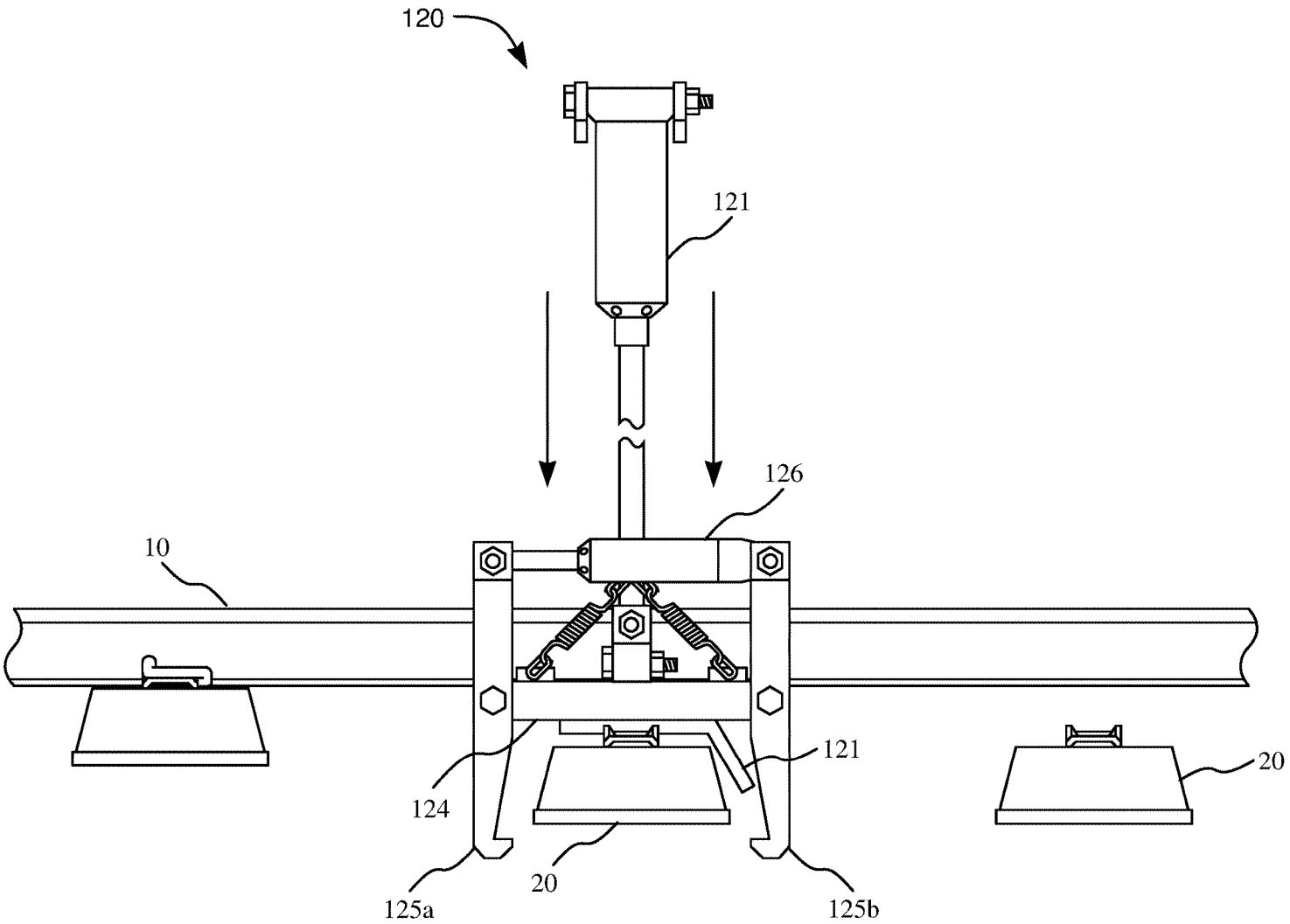
FIG. 8 is an operational side view of the jaw assembly illustrating the positioning of the jaw assembly at a steel tie.
Figure 9:
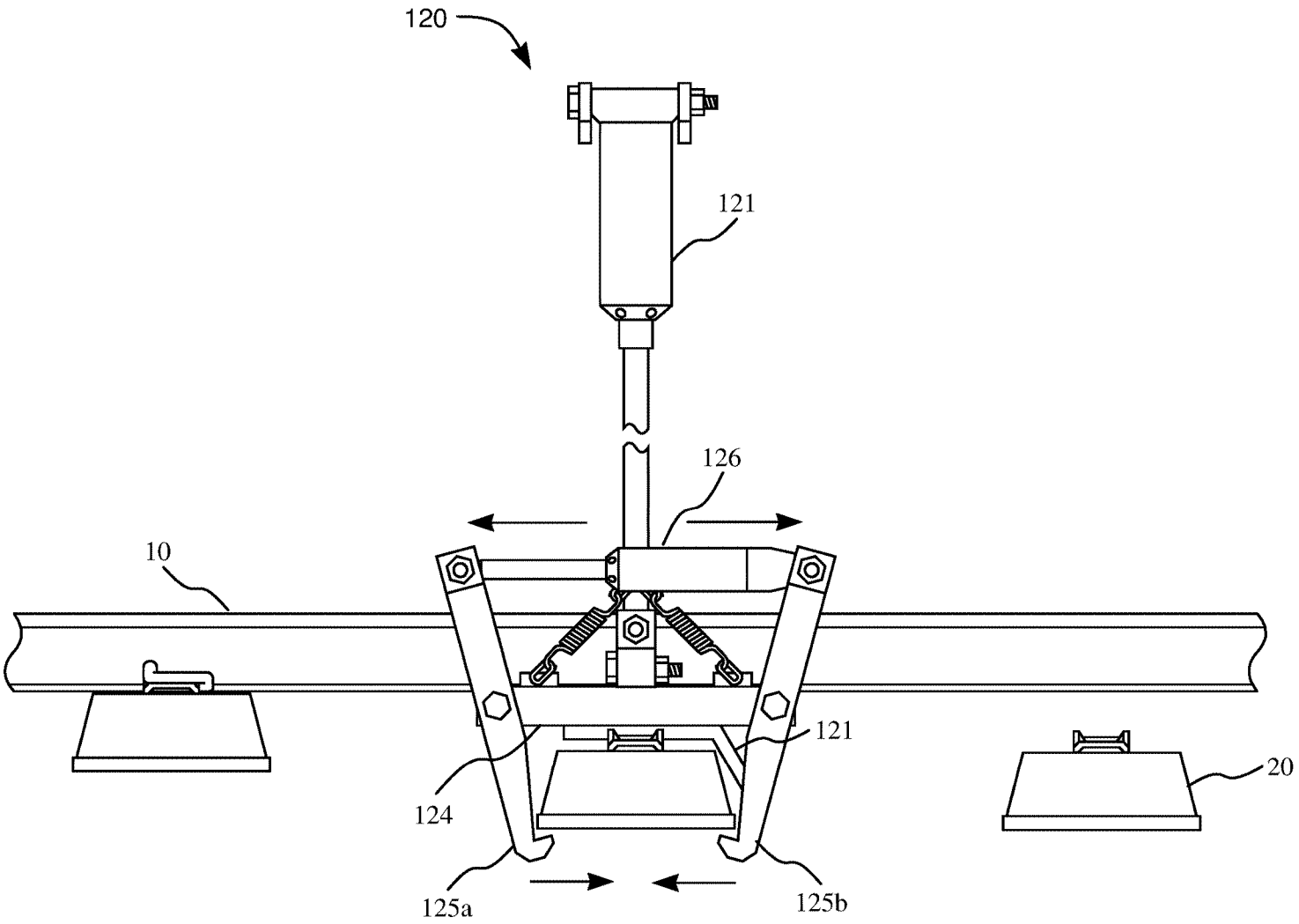
FIG. 9 is an operational side view of the jaw assembly illustrating closing the jaw grips on a steel tie.
Figure 10:
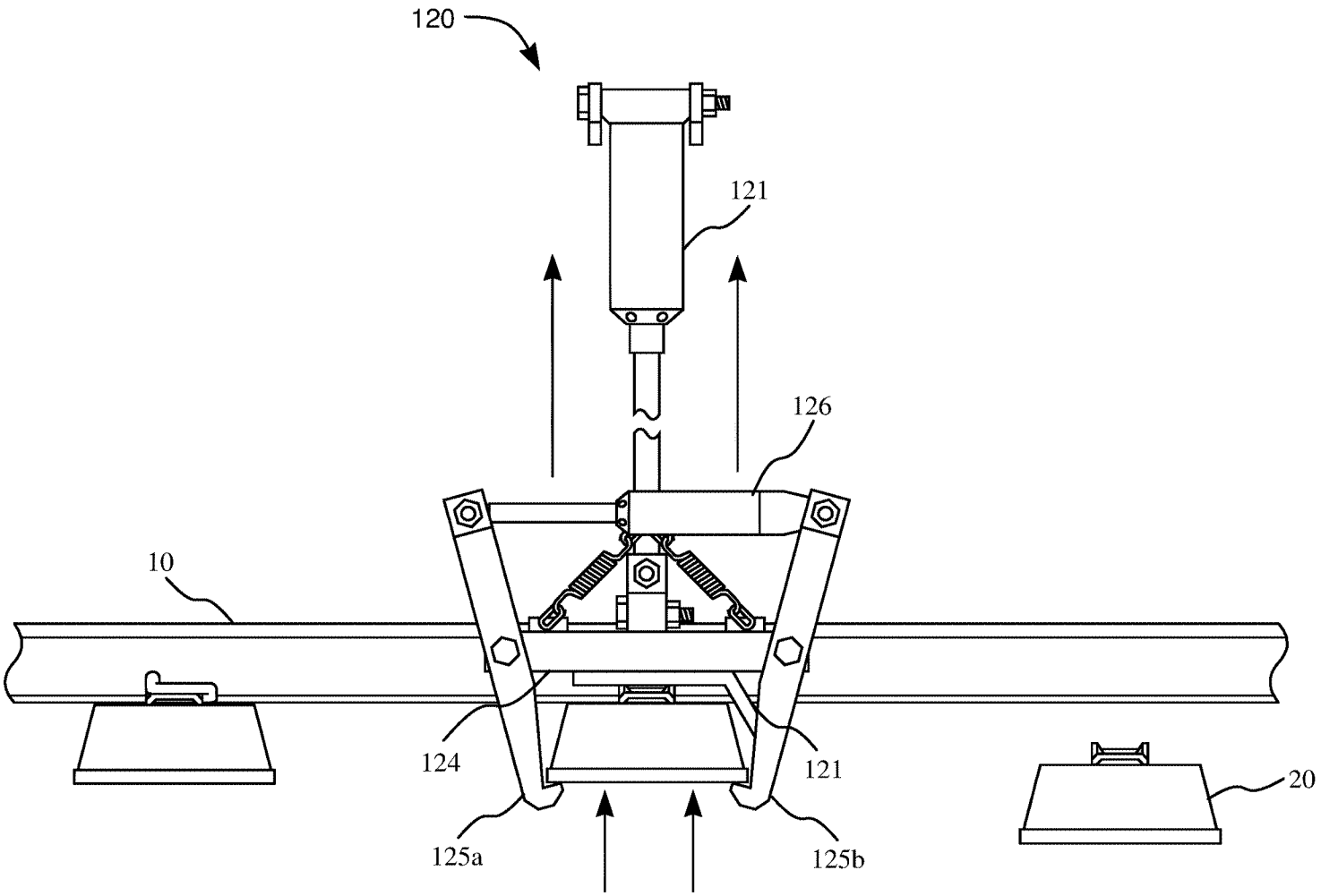
FIG. 10 is an operational side view of the jaw assembly illustrating lifting the steel tie against the underside of a rail.

FIG. 8 is an operational side view of the jaw assembly 120 illustrating the positioning of the jaw assembly 120 at a steel tie 20. FIG. 9 is an operational side view of the jaw assembly 120 illustrating closing the jaw grips 125*a*, 125*b* on a steel tie 20. FIG. 10 is an operational side view of the jaw assembly 120 illustrating lifting the steel tie 20 against the underside of a rail 10. As can be observed in FIG. 8, the downward arrows indicate that the piston rod of the jaw position hydraulic cylinder 121 extends downward forcing the jaw grips 125*a*, 125*b* down into the rail bed around the steel ties 20.

After the jaw grips 125*a*, 125*b* have been sufficiently lowered into the rail bed, each of the jaw grip hydraulic cylinders 126 are operable as necessary to contract and provide enough opening of the jaw grips 125*a*, 125*b* to extend beyond the width of the steel tie 20. The operator lowers the jaw grips 125*a*, 125*b* sufficiently so that the hook ends of the jaw grips 125*a*, 125*b* extend below the lower level of the steel tie 20.

As in FIG. 9, once the hook ends of the jaw grips 125*a*, 125*b* are sufficiently lowered below the steel tie 29, the jaw grip hydraulic cylinders 126 corresponding to each of the jaw grips 125*a*, 125*b* are extended so that the hook end of the jaw grips 125*a*, 125*b* are closed toward the steel tie 20 from each side. As is evident in FIG. 9, the jaw grips 125*a*, 125*b* are closed on the steel tie 20.

As shown in FIG. 10, with the jaw grips 125*a*, 125*b* closed on the steel tie 20, the piston rod of the jaw position hydraulic cylinder 121 retracts into its cylinder barrel, thus drawing the jaw assembly upward. Since the steel tie 20 is secure within the jaw grips 125*a*, 125*b* of the jaw assembly 120, this retraction draws the steel tie 20 upward against the underside of both rails 10 of the railroad track. With the steel tie 20 secured against the rails 10, the clamp mechanisms 130 are utilized as below to secure the e-clips 40 to the shoulder clips 30 of the steel tie 20. After the clamp mechanisms 130 have secured the e-clips 40, the respective jaw grip hydraulic cylinders 126 are contracted to open the jaw grips 125*a*, 125*b* and release the steel tie 20. The jaw position hydraulic cylinder 121 then retracts into its cylinder barrel to draw the jaw assembly upward and away from the railroad tracks. At this point, the e-clip installation machine 100 can be moved along the track to the next available steel tie 20 to begin the process again.

Figure 11:
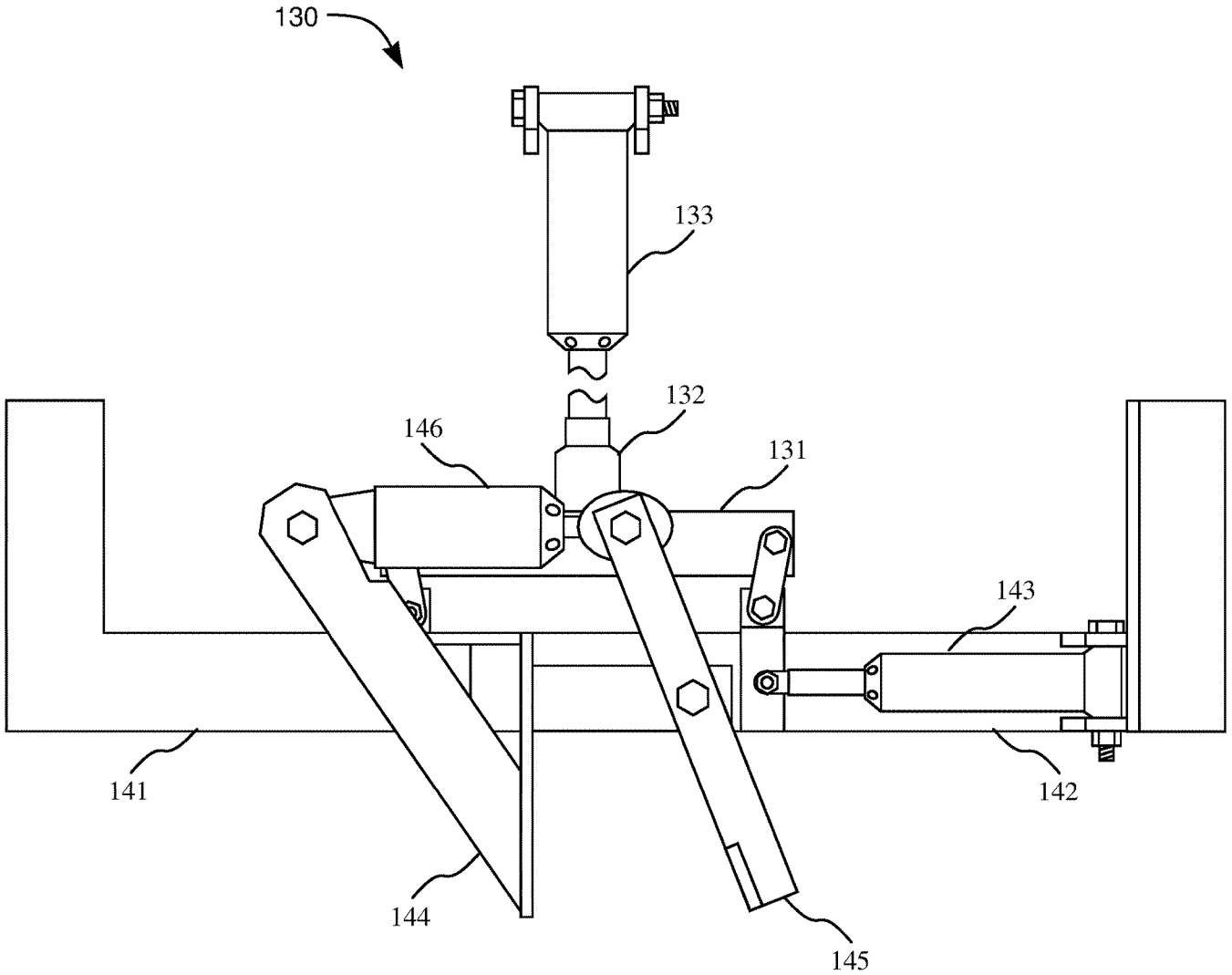
FIG. 11 is a side view of a clamp mechanism.
Figure 12:
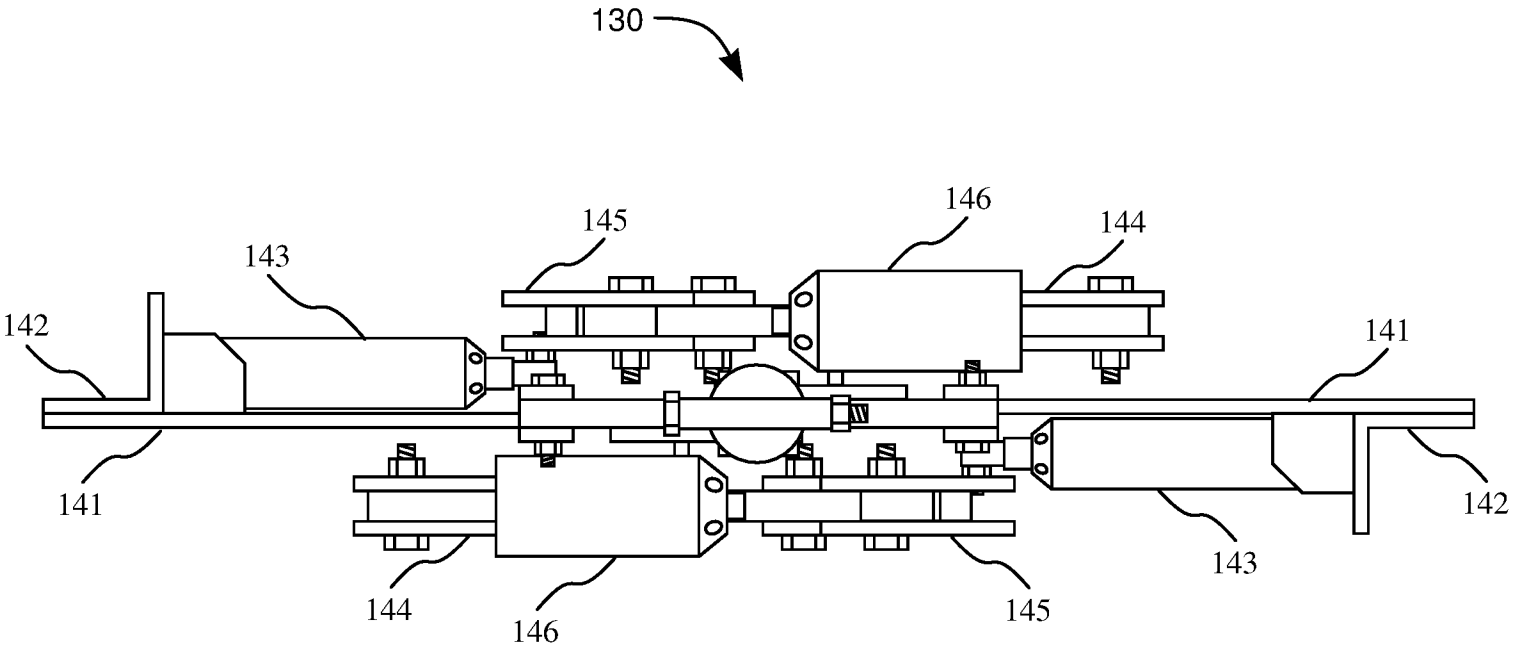
FIG. 12 is a top view of a clamp mechanism.

FIG. 11 is a side view of a clamp mechanism 130, and FIG. 12 is a top view of a clamp mechanism 130. The clamp mechanism 130 includes a clamp support frame 131, a clamp support mount 132, and a clamp support hydraulic cylinder 133. The clamp mechanism 130 also includes a brace frame 141, a hydraulic frame 142, a hydraulic frame cylinder 143, a clamp brace 144, a clamp arm 145, and a clamp hydraulic cylinder 146.

As noted previously, the e-clip installation machine 100 improves the process of securing the rails 10 to the steel ties 20 via increasing the efficiency of inserting e-clips 40 into respective shoulder clips 30 affixed on either side of the two rails 10 of the railroad track. As described above, the jaw assembly 120, utilizes a pair of hydraulic jaws to clamp the steel tie 20 and lift it against the underside of the rails 10. The respective pairs of e-clips 40, two clips for each rail 10, are then placed in position at the respective shoulder clips 30. At this juncture, the clamp mechanisms 130 at either end of the e-clip installation assembly 110 provide for pressing the respective e-clips 40 through openings within the respective shoulder clips 30.

The e-clip installation assembly 110 includes two clamp mechanisms 130 for securing a pair of e-clips 40 to a pair of shoulder clips 30 at each end of the steel tie 20. Each clamp mechanism 130 includes a clamp support frame 131. A clamp support hydraulic cylinder 133 connects to a clamp support mount 132 on the clamp support frame 131. The clamp support hydraulic cylinder 133 extends downward from the upper portion of the e-clip installation assembly 110. The piston rod of the clamp support hydraulic cylinder 133 extends downward from the cylinder barrel to the clamp support mount 132 on the clamp support frame 131.

The clamp mechanism 130 includes two clamp portions at the clamp support frame 131. A clamp portion is visible in FIG. 11 attached to the clamp support frame 131. As shown in FIG. 12, the top view of the clamp mechanism reveals a second clamp portion mirroring the first clamp portion. The two clamp portions are situated on either side of the corresponding rail 10 and are thus situated on either side of the clamp support frame 131.

The brace frame 141 and the hydraulic frame 142, together with the hydraulic frame cylinder 143, are operable to position the clamping portion in alignment with the shoulder clip 30 along the length of the rail above the steel tie 20. The hydraulic frame cylinder 143 acts to compress or expand the two frame pieces so that the shoulder clip 30 fits between the clamping portion of the clamp mechanism 130. This functionality provides leeway in the movement of the e-clip installation assembly 110 so that the various components can be properly aligned for the respective actions.

After the two frame pieces, the brace frame 141 and the hydraulic frame 142, are properly aligned in conjunction with the shoulder clip 30, the clamping portion is operable to clamp the e-clip 40 into place. The clamping portion of the clamp mechanism 130 includes the clamp brace 144, the clamp arm 145, and the clamp hydraulic cylinder 146. The clamp brace 144 provides a brace for the e-clip 40. The clamp arm 145 presses the e-clip 40 through the opening of the shoulder clip 30. The clamp brace 144 provides a resistance to the pushing motion of the clamp arm 145. This compression action secures the e-clip 40 in place with a portion extending into the shoulder clip 40 and with a parallel portion atop the flat portion of the rail 10 to which the steel tie 20 adjoins.

The action of the clamp hydraulic cylinder 146 is mirrored by the corresponding clamp hydraulic cylinder 146 on the opposite side of the clamp support frame 131. What this entails is that both the clamping portions of the respective clamp mechanism 130 operate at the same time to secure the corresponding e-clips 40 to the steel tie 20 on either side of the rail 10. Once the clamping operation is completed at the rail 10 for one end of the steel tie 20, the clamping operation may be performed at the other rail 10 at the other end of the steel tie 20.

Figure 13:
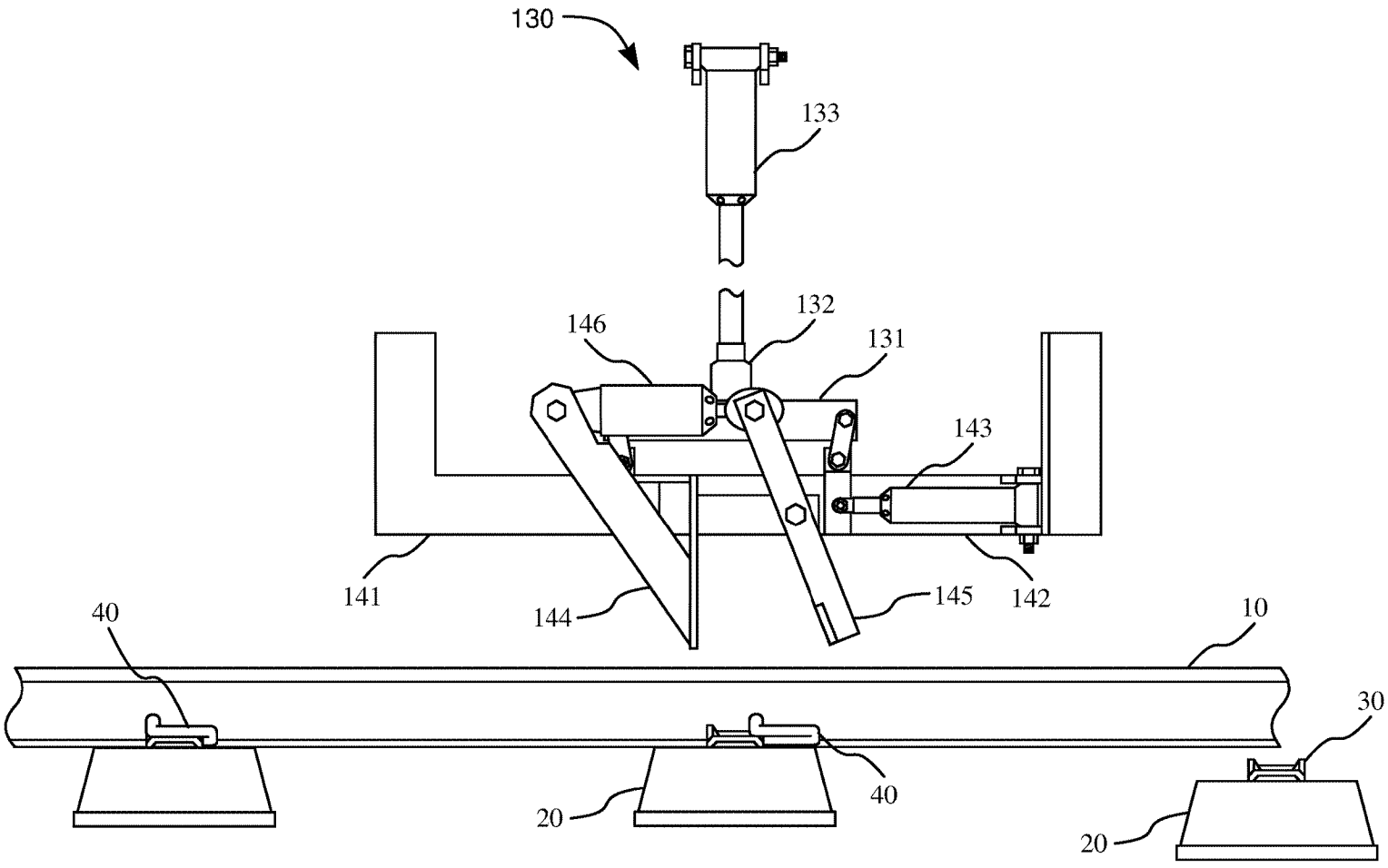
FIG. 13 is an operational side view of a clamp mechanism illustrating an initial position for installing an e-clip.
Figure 14:
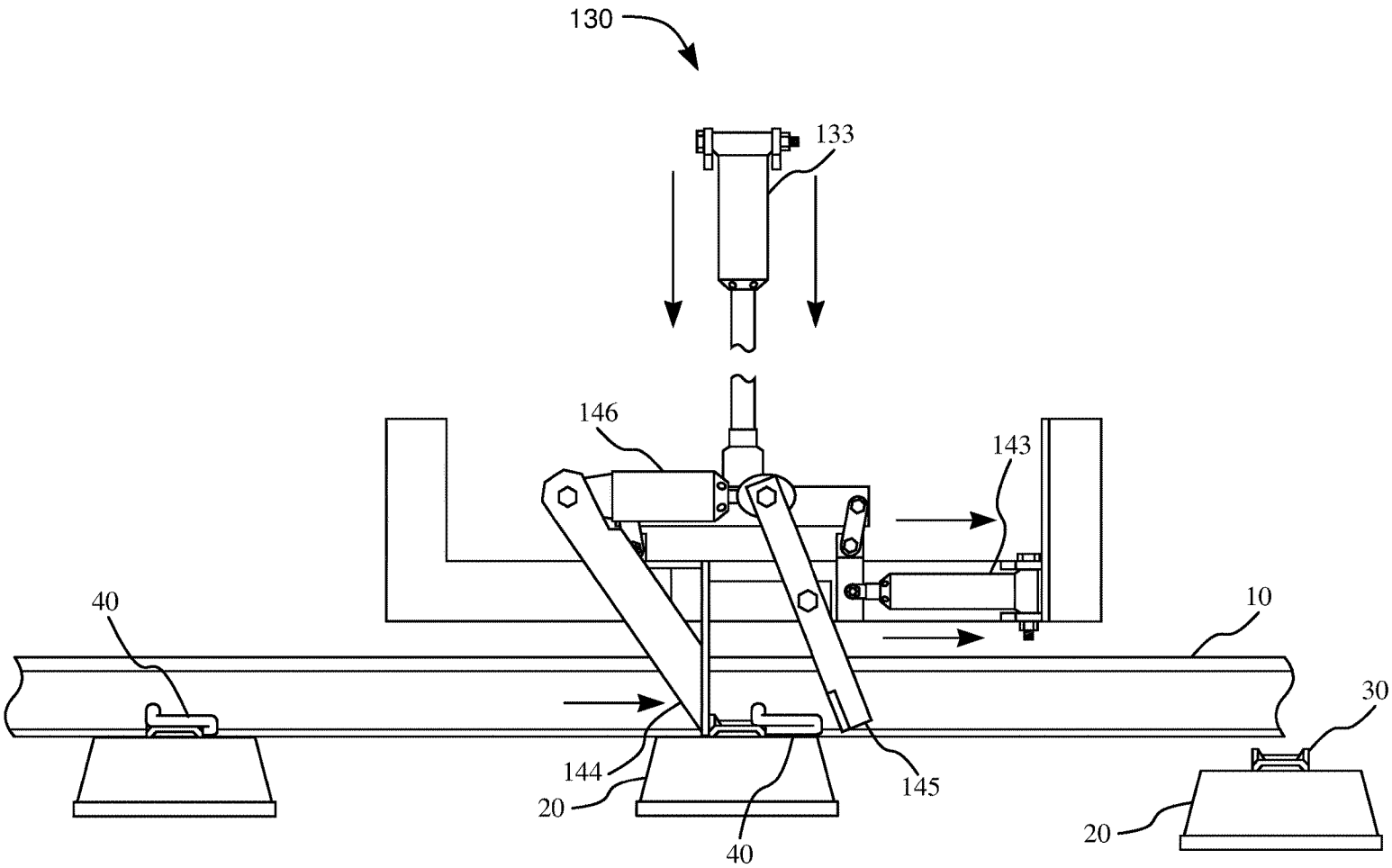
FIG. 14 is an operational side view of a clamp mechanism illustrating partial engagement for installing an e-clip.
Figure 15:
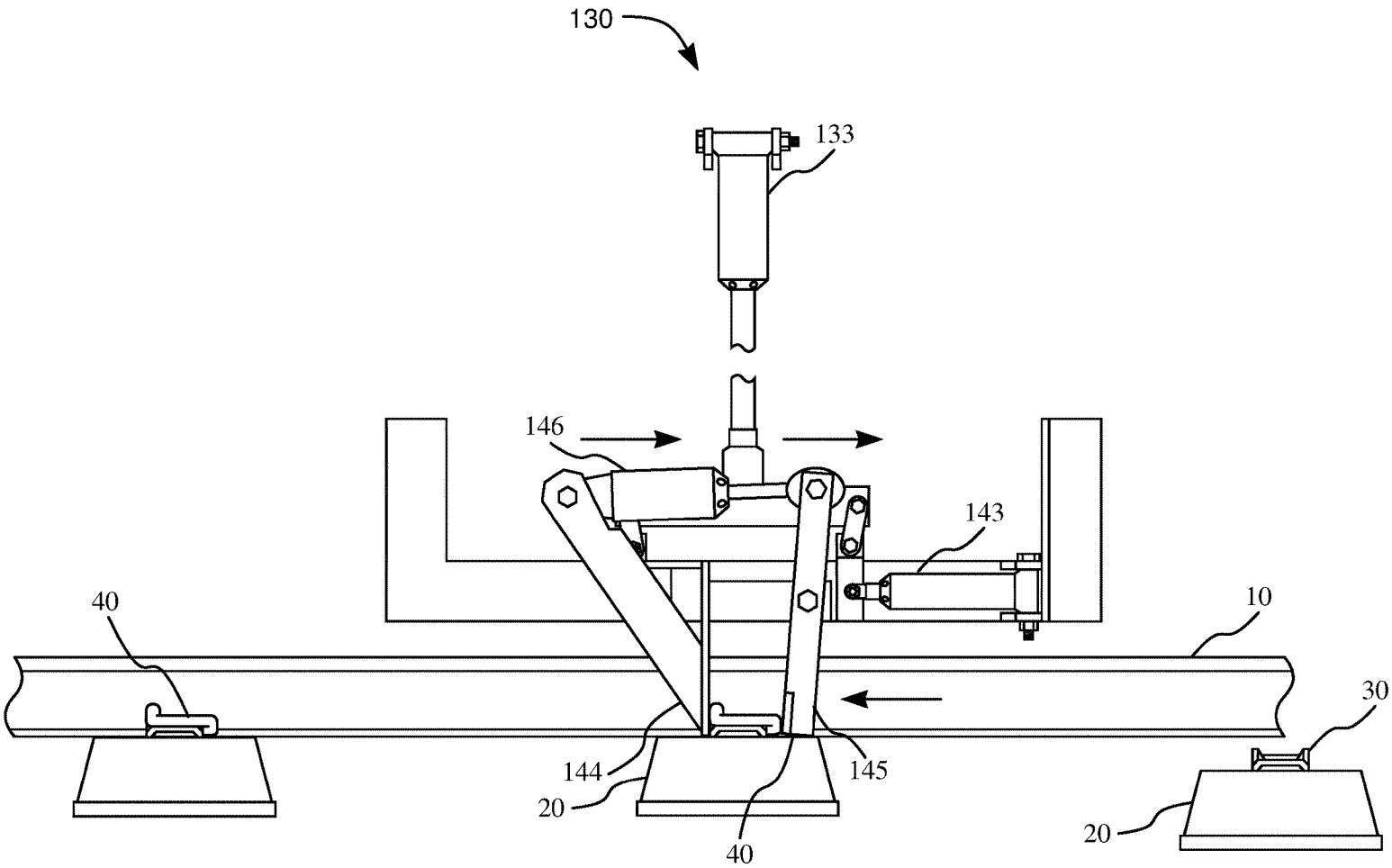
FIG. 15 is an operational side view of a clamp mechanism illustrating engagement and an installed e-clip.
Figure 16:
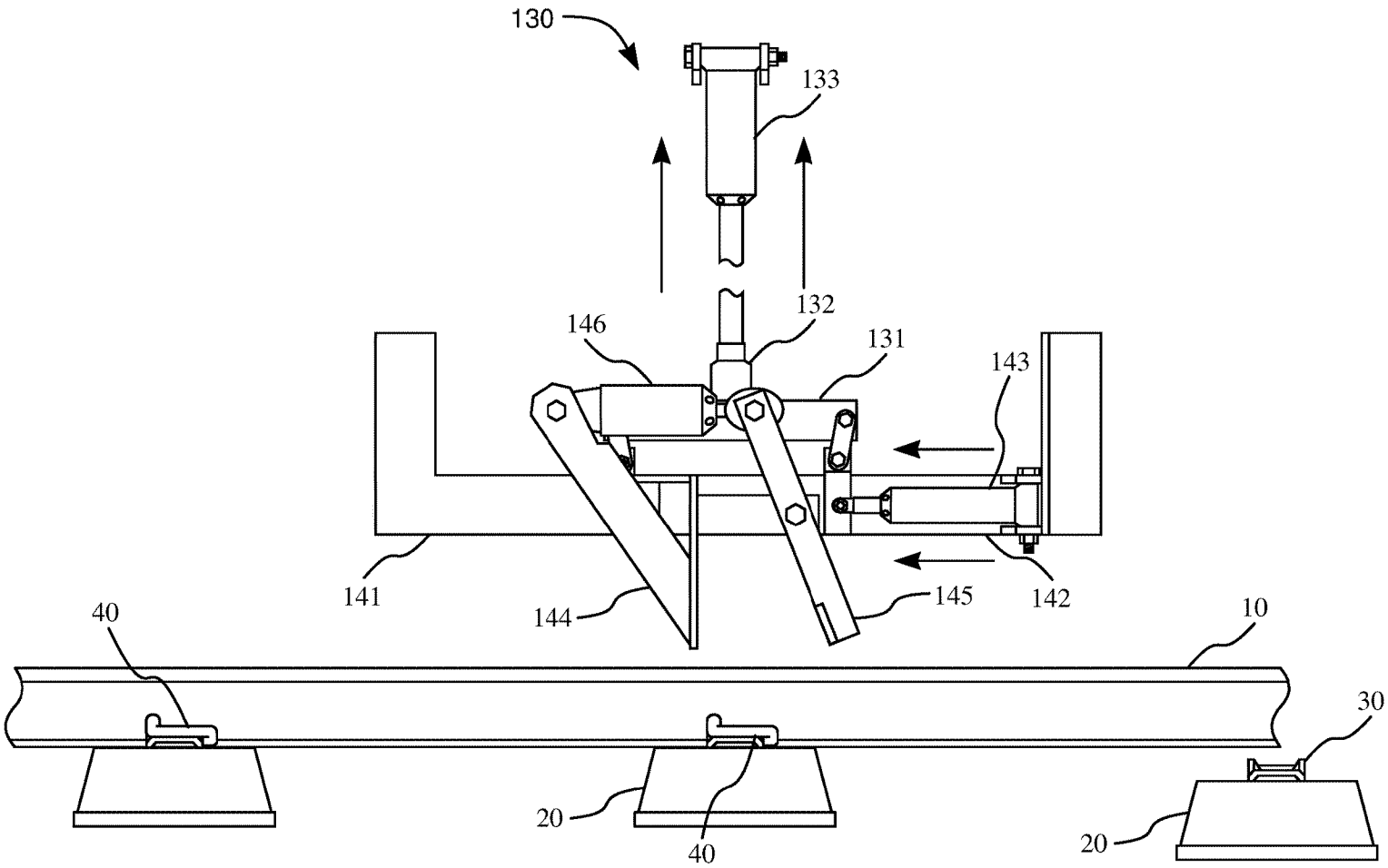
FIG. 16 is an operational side view of a clamp mechanism illustrating disengagement after installation of an e-clip and having returned to a neutral position.

FIG. 13 is an operational side view of a clamp mechanism 130 illustrating an initial neutral position for beginning the installation an e-clip 40. FIG. 14 is an operational side view of a clamp mechanism 130 illustrating partial engagement of the clamping portion for installing an e-clip 40 into a shoulder clip 30 on a steel tie 20. FIG. 15 is an operational side view of a clamp mechanism 130 illustrating engagement of the clamping portion during installation of the e-clip 40 into the opening of the shoulder clip 30. FIG. 16 is an operational side view of a clamp mechanism 130 further illustrating disengagement after successful installation of an e-clip 40 and having returned the clamping mechanism 130 to a neutral position in preparation for moving to the next available steel tie 20.

FIG. 13 illustrates the clamp mechanism 130 in a neutral or disengaged position prior to beginning the installation of an e-clip 40 to secure the rail 10 to the steel tie 20. In FIG. 13, it is apparent that an e-clip 40 has been installed in the shoulder clip 30 on the left side of the drawing. The successful installation of the e-clip 40 is further evident in that the steel tie 20 is compressed tightly against the underside of the rail 10 while the e-clip 40 is aligned in a manner that makes it apparent that it has been compressed through a portion of the shoulder clip 30. While the steel tie 20 in the center of the drawing has been lifted against the underside of the rails 10 by the jaw assembly 20, not shown in this drawing, it is also apparent that the e-clip 40 has not yet been pressed into its final position.

It is clear that the steel tie 20 to the right has not yet been lifted up against the underside of the rails 10. From FIG. 13, it is also clear that the installation of the e-clips 40 is progressing from left to right on the illustrated railroad track.

FIG. 14 illustrates the clamping portion of the clamp mechanism 130 has been properly aligned with the shoulder clip 30. As noted above and evident by the arrows suggesting actions, the hydraulic frame cylinder 143 acts to compress or expand the two frame pieces so that the shoulder clip 30 fits between the clamping portion of the clamp mechanism 130. FIG. 14 shows a partial engagement of the clamping portion for installing an e-clip 40 into the shoulder clip 30 on the steel tie 20. In this instance, partial engagement is that the clamp brace 144 is positioned against the shoulder clip 30 to provide resistance to the imminent action of the clamp arm 145.

FIG. 15 illustrates the engagement of the clamping portion during installation of the e-clip 40 into the opening of the shoulder clip 30. After the brace frame 141 and the hydraulic frame 142 are properly aligned in conjunction with the shoulder clip 30, the e-clip 40 is clamped into place via the action of the clamp hydraulic cylinder 146 to compress the clamp arm 145 against the e-clip 40 and toward the clamp brace 144.

As noted above, the clamp brace 144 provides a stop for the e-clip 40. The clamp arm 145 presses the e-clip 40 through the opening of the shoulder clip 30. The clamp brace 144 provides a resistance to the pushing motion of the clamp arm 145. This compression action secures the e-clip 40 in place with a portion extending into the shoulder clip 30 and with a parallel portion atop the flat portion of the rail 10 to which the steel tie 20 adjoins.

FIG. 16 illustrates disengagement of the clamp mechanism 130 after successful installation of an e-clip 40 and having returned the clamping mechanism 130 to a neutral position in preparation for moving to the next available steel tie 20. After the e-clip 40 has been secured in place within the shoulder clip 30, the clamp hydraulic cylinder 146 provides for the release and opening of the clamp arm 145 back to a neutral position so that the clamp mechanism 130 is disengaged from action. The clamp support hydraulic cylinder 133 retracts the clamp mechanism 130 upward so that the e-clip installation machine 100 can move forward to the next available steel tie 20.

Figure 17:
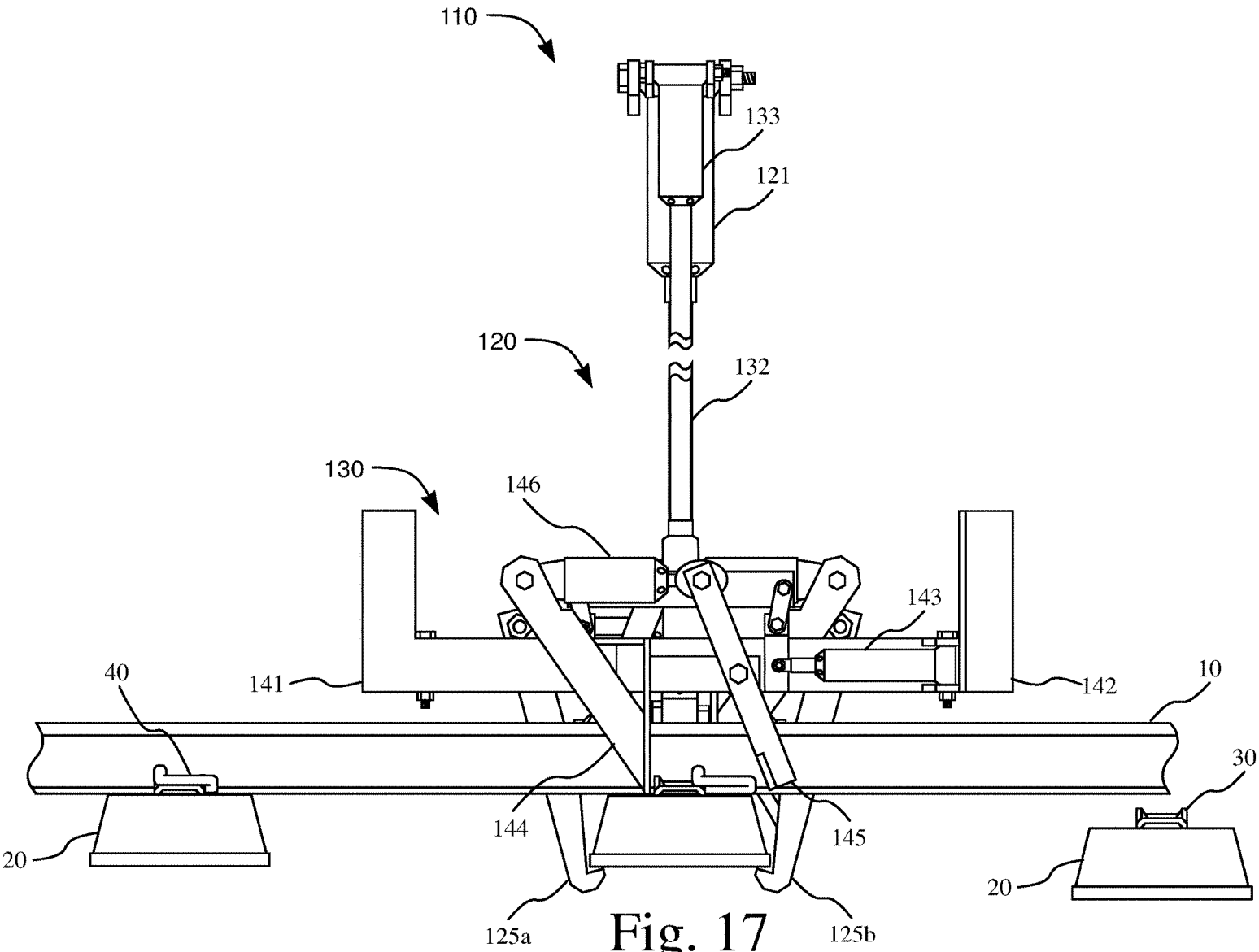
FIG. 17 is an operational side view of the e-clip installation assembly during engagement for the installation of an e-clip.
Figure 18:
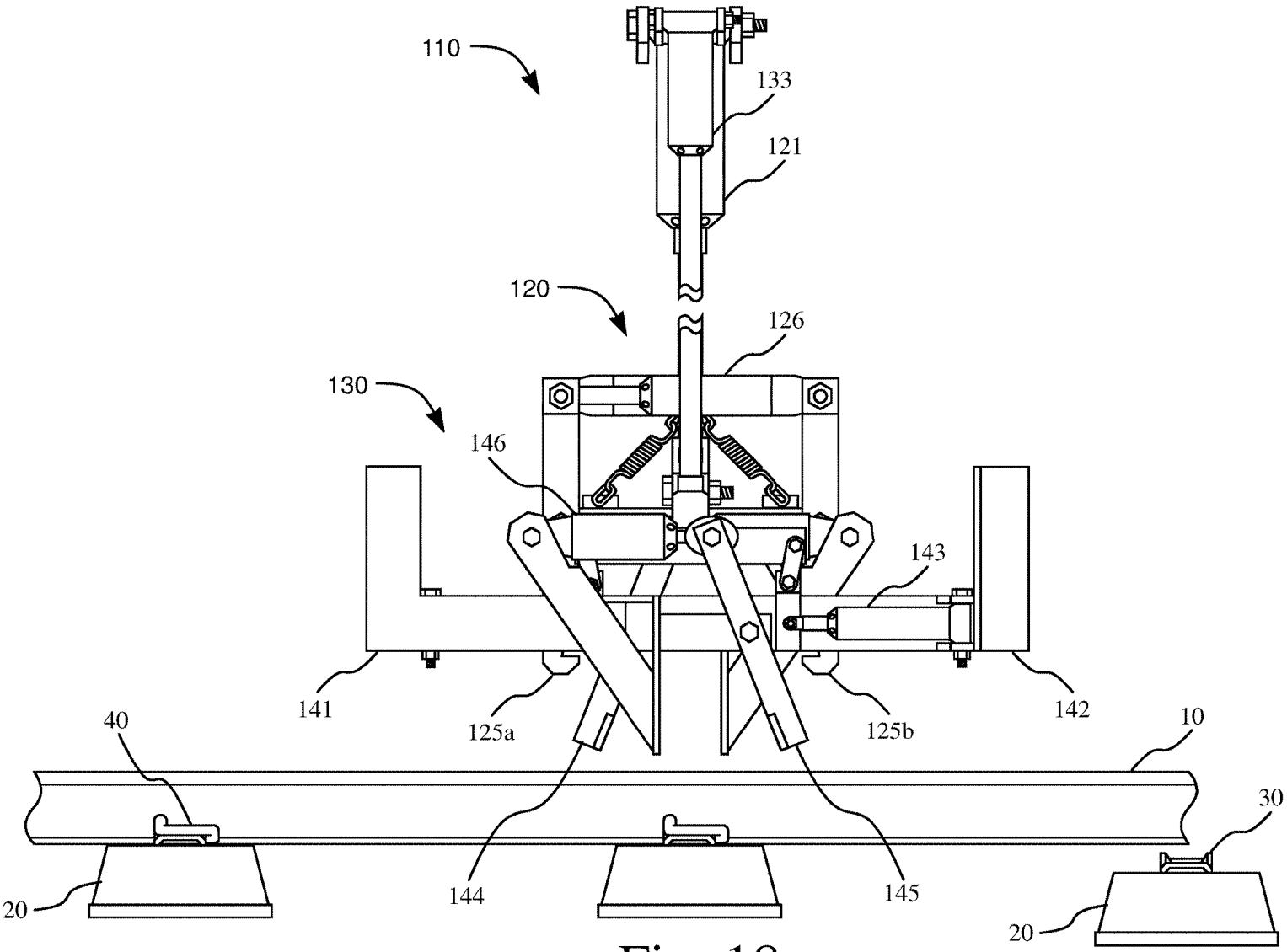
FIG. 18 is an operational side view of the e-clip installation assembly illustrating disengagement after the installation of an e-clip.

FIG. 17 is an operational side view of the e-clip installation assembly 110 during engagement for the installation of an e-clip 40. FIG. 18 is an operational side view of the e-clip installation assembly 110 illustrating disengagement after the installation of an e-clip 40. The illustration provided shows the installation of an e-clip 40 as it would actually occur with the e-clip installation assembly 110. While the previous disclosures have discussed the jaw assembly 120 and the clamp mechanism 130 separately, both the jaw assembly 120 and the clamp mechanism 130 are shown together in FIG. 17 and FIG. 18 as they actually exist and function in the e-clip installation machine 100.

FIG. 17 shows the clamp mechanism 130 having a partial engagement of the clamping portion for installing an e-clip 40 into the shoulder clip 30 on the steel tie 20. The e-clip 40 is shown already in position at the shoulder clip 30 with the clamp arm 145 in position to compress the e-clip 40 through the opening of the shoulder clip 30. Of course, the jaw assembly 120 is shown having utilized the jaw grips 125*a*, 125*b* to grasp the steel tie 20 and raise it upward against the underside of the rails 10.

In FIG. 17, an e-clip 40 has already been installed in the shoulder clip 30 on the left side of the drawing. The successful installation of the e-clip 40 is evident since the steel tie 20 is compressed tightly against the underside of the rail 10 while the e-clip 40 is aligned in a manner that shows it has been compressed through a portion of the shoulder clip 30. While the steel tie 20 in the center of the drawing has been lifted against the underside of the rails 10 by the jaw assembly 20, it is also apparent that the e-clip 40 has not yet been pressed into its final position. The steel tie 20 to the right has not yet been lifted up against the underside of the rails 10. From FIG. 17, it is also clear that the installation of the e-clips 40 is progressing from left to right on the illustrated railroad track.

FIG. 18 shows the clamp mechanism 130 having disengaged after successful installation of an e-clip 40 and having returned the clamping mechanism 130 to a neutral position in preparation for moving to the next available steel tie 20. After the e-clip 40 has been secured in place within the shoulder clip 30, the clamp hydraulic cylinder 146 provides for the release and opening of the clamp arm 145 back to a neutral position so that the clamp mechanism 130 is disengaged from action. The clamp support hydraulic cylinder 133 retracts the clamp mechanism 130 upward to a neutral and disengaged position in preparation for moving forward to the next available steel tie 20. After the clamp mechanisms 130 has been retracted, the respective jaw grip hydraulic cylinders 126 are contracted to open the jaw grips 125*a*, 125*b* and release the steel tie 20. The jaw position hydraulic cylinder 121 then retracts into its cylinder barrel to draw the jaw assembly upward and away from the railroad tracks. At this point, the e-clip installation machine 100 can be moved along the track to the next available steel tie 20 to begin the process again.

From the foregoing description, it will be recognized by those skilled in the art that an e-clip installation machine 100 for securing rails 10 to steel ties 10, has been provided. The e-clip installation machine 100 provides for automating and reducing the time required for installing e-clips 40 that attach the rails 10 to steel ties 20. The e-clip installation machine 100 improves the process of securing the rails 10 to the steel ties 10 via increasing the efficiency of inserting e-clips 40 into a respective shoulder clip 30 on either side of the two rails 10. A jaw assembly 120 clamps the steel tie 20 and brings it up against the underside of the rails 10. Two e-clips 40 for each rail 10 are placed in position at the respective shoulder clips 30. Two pairs of hydraulic clamp mechanisms 130, corresponding to each rail 10, press the respective e-clips 40 through openings within the respective shoulder clips 30. The e-clip installation assembly 110 includes a jaw assembly 120 and two clamp assemblies. Each clamp assembly includes a pair of clamp mechanisms 130, positionable on either side of a rail 10 in proximity to a shoulder clip 30 affixed to a steel tie 20. A clamp mechanism 130 is utilized to compress an e-clip 40 within an opening of the shoulder clip 30.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. A railroad e-clip installation machine, the e-clip installation machine comprising:

two clamp assemblies, each clamp assembly corresponding to one of two railway rails, each clamp assembly further including a pair of clamp mechanisms, each clamp mechanism configured for positioning at opposite sides of the corresponding railway rail, in proximity to one of two shoulder clips affixed to a steel tie near an end of the steel tie associated with the corresponding railway rail, so that each clamp mechanism is operable to compress an e-clip within an opening of the respective shoulder clip;

a jaw assembly situated substantially midway between the two clamp assemblies, the jaw assembly including two pairs of jaw grips having hooked ends and positionable to straddle a steel tie along its length, and further operable to close upon and lift the steel tie upwards against respective railway rails, the jaw assembly further comprising:

a mounting attachment for lowering the jaw assembly into position at the steel tie; and a jaw guide attached to the mounting attachment beneath a jaw brace, the jaw guide comprising a horizontal flat plate material further including an angled portion extending partially downward for substantial alignment against an angled edge of the steel tie, wherein the two clamp assemblies are utilized to install respective e-clips at each of two shoulder clips near each end of the steel tie.

2. The railroad e-clip installation machine of claim 1, each jaw grip further comprising a hook portion, each hook portion positionable for gripping below the steel tie and lifting the steel tie against the respective railway rails.

3. The railroad e-clip installation machine of claim 2, the jaw assembly further comprising a jaw grip hydraulic cylinder for each pair of jaw grips for opening and closing the respective pair of jaw grips.

4. The railroad e-clip installation machine of claim 3, each clamp assembly further comprising two clamp mechanisms, each clamp mechanism including a clamp support frame.

5. The railroad e-clip installation machine of claim 4, each clamp mechanism further comprising two clamp portions at the clamp support frame, the two clamp portions positionable on either side of the respective rail.

6. The railroad e-clip installation machine of claim 5, each clamp mechanism further comprising a clamp hydraulic cylinder for closing and opening the respective clamp portions to secure a respective e-clip within an opening of a respective shoulder clip.

7. A railroad e-clip installation machine, the e-clip installation machine comprising:

two clamp assemblies, each clamp assembly corresponding to one of two railway rails, each clamp assembly further including a pair of clamp mechanisms, each clamp mechanism configured for positioning at opposite sides of the corresponding railway rail, in proximity to one of two shoulder clips affixed to a steel tie near an end of the steel tie associated with the corresponding railway rail, so that each clamp mechanism is operable to compress an e-clip within an opening of the respective shoulder clip, each clamp assembly further including;

two clamp mechanisms, each clamp mechanism including a clamp support frame;

two clamp portions at each clamp support frame, the two clamp portions positionable on either side of the respective railway rail; and a clamp hydraulic cylinder for closing and opening the respective clamp portions to secure respective e-clips to the corresponding shoulder clip; and a jaw assembly situated substantially midway between the two clamp assemblies, the jaw assembly including two pairs of jaw grips positionable to straddle a steel tie along its length, and further operable to close upon and lift the steel tie upwards against respective railway rails, the jaw assembly further including:

a mounting attachment for lowering the jaw assembly into position at the steel tie;

a jaw guide attached to the mounting attachment beneath a jaw brace, the jaw guide comprising a horizontal flat plate material further including an angled portion extending partially downward for substantial alignment against an angled edge of the steel tie;

each jaw grip further comprising a hook portion, each hook portion positionable for gripping below the steel tie and lifting the steel tie against the respective railway rails; and a jaw grip hydraulic cylinder for each pair of jaw grips for opening and closing the respective pair of jaw grips, wherein the two clamp assemblies are utilized to install respective e-clips at each of two shoulder clips near each end of the steel tie.

8. A railroad e-clip installation machine, the e-clip installation machine consisting of:

two clamp assemblies, each clamp assembly corresponding to one of two railway rails, each clamp assembly further including a pair of clamp mechanisms, each clamp mechanism configured for positioning at opposite sides of the corresponding railway rail, in proximity to one of two shoulder clips affixed to a steel tie near an end of the steel tie associated with the corresponding railway rail, so that each clamp mechanism is operable to compress an e-clip within an opening of the respective shoulder clip, each clamp assembly further including;

two clamp mechanisms, each clamp mechanism including a clamp support frame;

two clamp portions at each clamp support frame, the two clamp portions positionable on either side of the respective railway rail; and a clamp hydraulic cylinder for closing and opening the respective clamp portions to secure respective e-clips to the corresponding shoulder clip; and a jaw assembly situated substantially midway between the two clamp assemblies, the jaw assembly including two pairs of jaw grips positionable to straddle a steel tie along its length, and further operable to close upon and lift the steel tie upwards against respective railway rails, the jaw assembly further including:

a mounting attachment for lowering the jaw assembly into position at the steel tie;

a jaw guide attached to the mounting attachment beneath a jaw brace, the jaw guide comprising a horizontal flat plate material further including an angled portion extending partially downward for substantial alignment against an angled edge of the steel tie;

each jaw grip further comprising a hook portion, each hook portion positionable for gripping below the steel tie and lifting the rail steel tie against the respective railway rails; and a jaw grip hydraulic cylinder for each pair of jaw grips for opening and closing the respective pair of jaw grips, wherein the two clamp assemblies are utilized to install respective e-clips at each of two shoulder clips near each end of the steel tie.

* * * * *